United States Patent [19]

Oven et al.

[11] 4,209,199

[45] Jun. 24, 1980

[54] MINERAL MINING MACHINES

[75] Inventors: Terence Oven; John T. Nicholls; Robert H. Higgs, all of Burton-on-Trent, England

[73] Assignee: Coal Industry (Patents) Limited, London, England

[21] Appl. No.: 954,428

[22] Filed: Oct. 25, 1978

[30] Foreign Application Priority Data

Nov. 11, 1977 [GB] United Kingdom ..... 47053/77

[51] Int. Cl.[2] ..... E21C 25/56

[52] U.S. Cl. ..... 299/43; 299/34; 299/82

[58] Field of Search ..... 299/43, 34, 42, 82

[56] References Cited

U.S. PATENT DOCUMENTS

| | | | |
|---|---|---|---|
| 3,388,948 | 6/1968 | Löbbe et al. | 299/34 |
| 3,658,385 | 4/1972 | Oven et al. | 299/43 |
| 4,025,117 | 5/1977 | Bahre | 299/34 |

FOREIGN PATENT DOCUMENTS

| | | | |
|---|---|---|---|
| 258211 | 10/1970 | U.S.S.R. | 299/43 |

*Primary Examiner*—William F. Pate, III

*Attorney, Agent, or Firm*—Stevens, Davis, Miller & Mosher

[57] ABSTRACT

A mineral mining machine incorporates a guideway defining runs for a cutter chain which carries cutter picks. The guideway is movable as a whole and is formed with runs for the chain. The runs of the guideway are of generally L-shaped cross section, although the invention is not so limited, and have relatively outer and relatively inner supporting guide surfaces for the cutter chain. The relatively inner guide surface is positioned to the rear of the drive member, e.g. a sprocket, for the chain, i.e. behind the center line of the chain in the cutting direction. The guide surfaces are continuous around the whole of the guideway thus providing continuous support for the chain during the whole of its movement around the guideway.

13 Claims, 3 Drawing Figures

MINERAL MINING MACHINES

This invention concerns improvements in or relating to mineral mining machines for advancing shortwall faces.

In particular the present invention has reference to a mineral mining machine of the type (hereinafter referred to as the type described) comprising a base having a leading portion adajcent the floor on which the machine is supported for advance over so as to form a conveying track for cut mineral extending lengthwise of the base, a rigid cutter member supported by the base for vertical movement as a whole relative to the base and including a guideway having upper and lower runs extending generally parallel to the conveying track, an endless cutter chain supported by the guideway, and a drive motor for the chain mounted on the member. The cutter member is preferably supported by a support member which is pivotally connected to the cutter member and to the base.

In the assignee's prior UK Pat. No. 1 240 450 there is described the same type of machine provided with supporting guideway sections adapted for slidable engagement by parts of slide members carried by the cutter chain. It has been found that guideway sections of this kind are satisfactory for medium to large seam heights and are of such design as to allow a machine operator access to the front part of the machine through the guideway between the upper and lower runs. Such access is necessary for maintenance purposes and for changing cutting picks mounted on the cutter chain; these operations are ideally carried out in situ as it is undesirable and time consuming if withdrawal of the machine from its cutting position adjacent the shortwall face were required for these maintenance purposes. However, with seam heights of between 28" to 36", the problem arises of providing sufficient clearance between the upper and lower runs of the guideway for the access described above.

Furthermore, with machines of this type and having the known type of guideway in which positive guidance is provided at the outer and inner margins of the guideway section, relief of the inner guide surface has proved necessary at the ends of the guideway section in the vicinity of the sprocket drive arrangements for the cutter chain. Accordingly either the cutter chain relies solely on the outer guide surface at the ends of the section or additional guide surfaces have had to be provided. This means that there is a lack of continuity of guide surfaces around the whole of the guideway section.

It is an object of the present invention to provide a machine of the type described which possesses the features necessary to achieve the continuity of guidance over the whole of the guideway section.

A further object of the invention is to provide a machine of the type described which is not only capable of operation in seam heights of the order indicated, but also permits access through the guideway for routine maintenance and pick replacement.

Accordingly the invention provides as a first aspect a mineral mining machine of the type described in which at least one drive member is provided for the endless cutter chain, the guideway has relatively outer and relatively inner supporting guide surfaces wherein the relatively inner guide surface is portioned to the rear of the or each drive member in the direction of machine advance.

In one embodiment, the guideway is substantially L-shaped in cross-section with the relatively inner guide surface on the upright limb of the guideway, the relatively outer guide surface being provided on the other limb of the L-shaped guideway.

According to a second aspect of the invention, there is provided a guideway for a machine of the type described, the guideway having relatively outer and relatively inner supporting guide surfaces wherein the relatively inner guide surface is, with the guideway on the machine, positioned to the rear of a drive member of the endless cutter chain.

The expression "substantially L-shaped" as used herein includes L-shaped and a shape approximating to an L and also embraces a shape similar to that of a J or any approximate equivalent to either.

In an alternative embodiment, the guideway need not be substantially L-shaped and may not be unitary. Thus, the relatively outer and relatively inner guide surfaces may be formed on separate members which together constitute the guideway.

Conveniently a first or relatively longer limb of the L-shaped guideway is orientated in use horizontally or substantially horizontally and carries the relatively outer supporting guide surface at its free end. This guide surface may be in the form of a rail attached to or integral with the free end of the limb.

The second or relatively shorter limb of the L-shaped guideway is in use in a vertical or substantially vertical plane and is provided with the relatively inner guide surface which may be located intermediate the ends of the limb or at the free end thereof on the under surface of the limb.

Preferably each guide surface is continuous around the whole of the guideway to provide guiding support for the cutter chain.

The cutter chain includes slide members and each of at least some of the members is provided with at least one engagement surface complementary to one guide surface on the guideway. The slide members preferably will have a corresponding number of engagement surfaces.

The slide members are attached to the links of the cutter chain by means of pivot pins which are conveniently insertable from the front of the guideway so as to extend towards the rear thereof formed by the second or relatively shorter limb of the L-shaped guideway. This facilitiates removal of the pin and substitution of slide members and pick boxes which in use are attached to the slide members and which carry picks for cutting mineral.

Conveniently loading means in the form of paddles are also attached to the cutter chain and are provided with engagement surfaces for engagement with at least one of the guide surfaces on the guideway.

By way of example only, one embodiment of mineral mining machine of the type described according to the invention is described below with reference to the accompanying drawings in which.

Figure 1:
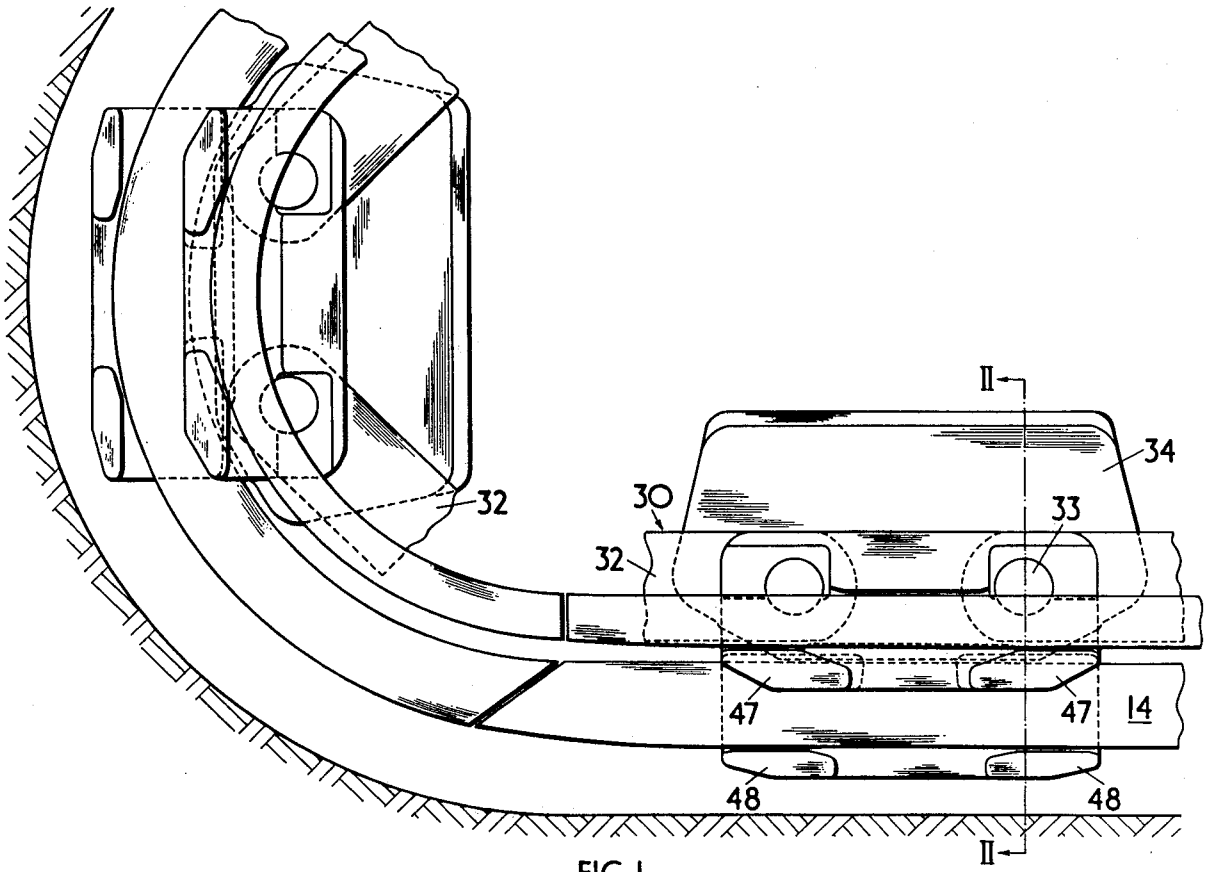
FIG. 1 is a rear view of part of the mineral mining machine.

Referring to the drawings, a mineral mining machine of the type described is shown generally at 1 and includes a conveying track (not shown) for cut mineral extending transversely to the direction of advance of the machine 1. A cutter member 2 is supported for vertical movement as a whole and comprises a guideway 3 having continuous upper and lower runs 4, 6 respectively spaced apart as shown in FIG. 2, the guideway 3 having arcuate end portions.

The guideway 3 is substantially L-shaped in cross-section with its relatively longer limb 8 orientated horizontally or substantially horizontally and is provided with relatively outer and relatively inner guide surfaces 10, 12 respectively. The surface 10 is in the form of a continuous rail 14 fixed by, for example, bolts 16 to the end of the limb 8; the surface 12 is located intermediate the ends of the relatively shorter limb 18 of the guideway 3 and consists of a continuous rail 20 bolted to the limb 18. It is to be understood that the rails 14, 20 may be formed integrally of the guideway 3.

Figure 2:
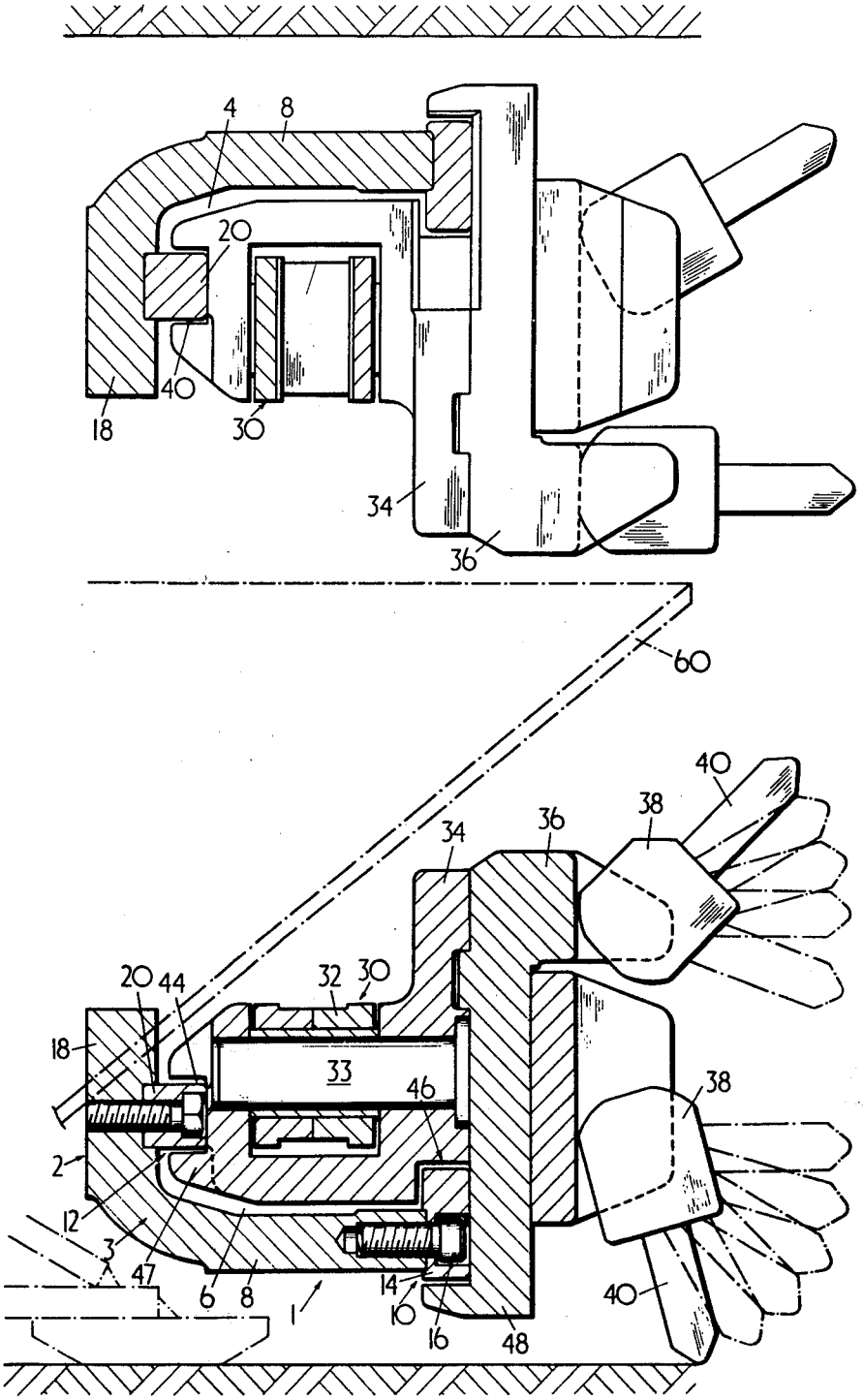
FIG. 2 is a sectional view of the line II—II of FIG. 1.

The cutter member 2 also includes a cutter chain 30 comprising links 32 to at least some of which are pivotally attached by headed pins 33 slide members 34 which in use carry cutter pick mounting plates 36 to which pick holders 38 are secured, picks being diagrammatically shown at 40 in FIG. 2. Each slide member 34 is formed in a rear portion thereof with an open-ended recess 44 locatable over and complementary to the rail 20, in use the recess 44 slidably engaging the rail 20. The rail 20 is positioned to the rear of the centre line of the chain 30 and thus to the rear of the drive member (not shown), e.g. a sprocket, provided for engaging the chain.

The slide member 34 is also provided with steps 46 formed by lugs 47 at a front portion thereof. Each pick mounting plate 36 has lips 48, the steps 46 and lips 48 together engaging the rail 14 in a complementary fashion thereby affording a trapping for the cutter chain 30 at the outer periphery of the guideway 3.

Figure 3:
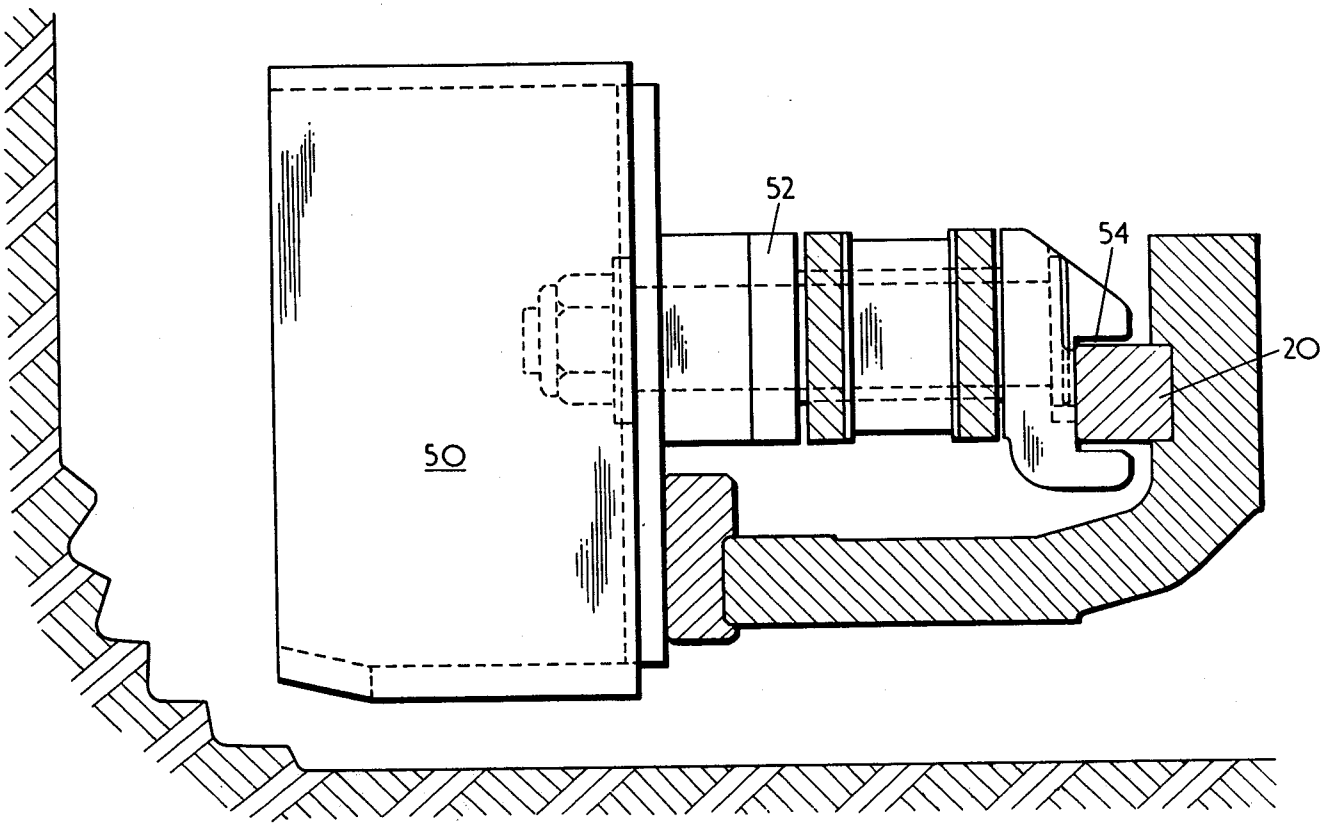
FIG. 3 is a sectional view corresponding to FIG. 2 but depicting a further detail of the mineral mining machine.

Also mounted on the chain 30 behind the picks in the direction of chain travel, are loading paddles 50, shown in FIG. 3, which are pivotally affixed to further slide members 52 each of which has a locating recess 54 for sliding engagement with the rail 20.

The paddles 50 serve to convey debris cut by the picks 40 towards a chute positioned between the space between the upper and lower runs 4, 6 towards one end of the machine 1, the chute feeding in use onto a conveyor (not shown).

The cutter chain 30 is in the form of an endless loop and engages two sprockets (not shown) located at respective ends of the guideway 3, one of the sprockets being driven by a motor suitably supported on the machine 1. The guideway 3 is pivotally mounted on a base (not shown), thereby enabling the cutter member 2 to be ranged in a vertical manner, the base being advanceable within a mineral seam and being provided with suitable staker means (not shown).

In use, the machine 1 is advanced into a shortwall face (not shown) and with the cutter chain 30 being driven by the sprocket and motor, wins mineral from the face. The forces exerted on the pick plates 36 during the cutting operation are resisted by the guideway 3 and in particular by the guide surfaces 10, 12 which not only serve positively to guide the cutter chain 30 and slide members 34 but also to prevent any tendency of the chain to turn under the influence of unbalanced cutting forces. Since the relatively inner guide surface 12 is positioned to the rear of the drive sprockets, it provides no obstruction to the smooth passage of the chain 30 over the sprockets and accordingly does not need to be relieved in the vicintiy thereof as with previous forms of guideway. The guide surfaces 10 and 12, therefore, are continuous around the whole of the guideway 3. It will also be noted that the pivoted attachment of the plates 36 to the chain 30 is effected by the headed pins 33 which can be withdrawn from the front, i.e. the pick side, of the machine 1.

This feature facilitates maintenance to the chain 30 from the front of the machine to which access is gained by an operative passing through the space between the upper and lower runs 4, 6 of the guideway 3. The cross-sectional form of the guideway is of advantage in providing this access especially for low seam height machines in which the conventional guideway would have prevented such access and also would have demanded a chute angle such that the flow of debris would have been impeded. With the machine of the present invention the angle of the chute 60 gives a smooth flow.

While the guideway of the present invention was conceived primarily for low height seams, it is to be understood that the guideaway may be employed on any machine of the type described without any limitation on the dimensional parameter.

We claim:

1. A mineral mining machine comprising a base having a leading portion adjacent the floor on which the machine is supported for advance over so as to form a conveying track for cut mineral extending lengthwise of the base, a rigid cutter member supported by the base for vertical movement as a whole relative to the base and including a guideway having upper and lower runs extending generally parallel to the conveying track, and endless cutter chain supported by the guideway and including slide members, a drive motor for the chain mounted on the cutter member, at least one drive member for the endless cutter chain, the guideway having relatively outer and relatively inner supporting guide surfaces, at least some of the slide members of the chain being provided with at least one engagement surface complementary to one of the guide surfaces of the guideway, and the relatively inner guide surface being positioned to the rear of the drive member in the direction of machine advance.

2. A machine according to claim 1 in which the guideway is substantially L-shaped in cross-section, a guide surface being provided on each limb of the guideway.

3. A machine according to claim 2 in which a first limb of the L-shaped guideway is orientated, in use, horizontally and carries the relatively outer supporting guide surface at its free end.

4. A machine according to claim 3 in which the relatively outer supporting guide surface is in the form of a rail.

5. A machine according to claim 3 in which a second limb of the L-shaped guideway is orientated, in use, vertically and carries the relatively inner supporting guide surface.

6. A machine according to claim 5 in which the relatively inner guide surface is located intermediate the ends of the second limb.

7. A machine according to claim 5 in which the relatively inner supporting guide surface is in the form of a rail.

8. A machine according to claim 1 in which the guide surfaces are continuous around the whole of the guideway.

9. A machine according to claim 1 in which the slide members have engagement surfaces for the relatively inner and relatively outer supporting guide surfaces.

10. A machine according to claim 1 in which loading means are attached to the cutter chain and are provided with engagement surfaces for engagement with at least one of the supporting guide surfaces on the guideway.

11. A mineral mining machine compirisng a base having a leading portion adjacent the floor on which the machine is supported for advance over so as to form a conveying track for cut mineral extending lengthwise of the base, a rigid cutter member supported by the base for vertical movement as a whole relative to the base and including a guideway having upper and lower runs extending generally parallel to the conveying track, an endless cutter chain supported by the guideway and including links and slide members attached to the links by means of pivot pins, a drive motor for the chain mounted on the cutter member, at least one drive member for the endless cutter chain, the guideway having relatively outer and relatively inner supporting guide surfaces, at least some of the slide members of the chain being provided with at least one engagement surface complementary to one of the guide surfaces of the guideway, and the relatively inner guide surface being positioned to the rear of the drive member in the direction of machine advance.

12. A mineral mining machine comprising a base having a leading portion adjacent the floor on which the machine is supported for advance over so as to form a conveying track for cut mineral extending lengthwise of the base, a rigid cutter member supported by the base for vertical movement as a whole relative to the base and including a guideway having upper and lower runs extending generally parallel to the conveying track, an endless cutter chain supported by the guideway and including links and slide members attached to the links by means of pivot pins, the pivot pins being insertable from the front of the guideway, a drive motor for the chain mounted on the cutter member, at least one drive member for the endless cutter chain, the guideway having relatively outer and relatively inner supporting guide surfaces, at least some of the slide members of the chain being provided with at least one engagement surface complementary to one of the guide surfaces of the guideway, and the relatively inner guide surface being positioned to the rear of the drive member in the direction of machine advance.

13. A machine according to claim 1, in which the guideway is in the form of a rail extending substantially continuously around the whole of the conveying track.

* * * * *